United States Patent [19]

Braun

[11] Patent Number: 4,686,917

[45] Date of Patent: Aug. 18, 1987

[54] MATERIAL THICKNESS SENSING DEVICE FOR SEWING MACHINES

[75] Inventor: Oskar Braun, Kaiserslauttern, Fed. Rep. of Germany

[73] Assignee: Pfaff Industriemaschinen GmbH, Fed. Rep. of Germany

[21] Appl. No.: 888,768

[22] Filed: Jul. 21, 1986

[30] Foreign Application Priority Data

Aug. 7, 1985 [DE] Fed. Rep. of Germany ..... 3528295

[51] Int. Cl.[4] ..... D05B 29/02; D05B 29/12; D05B 27/24

[52] U.S. Cl. ..... 112/311; 112/320; 324/229

[58] Field of Search ..... 324/71.1, 229, 231; 33/172 B, 171, 169 F, 169 R; 112/272, 311, 320

[56] References Cited

U.S. PATENT DOCUMENTS 3,665,743 5/1972 Frohling ..... 324/229 X
4,038,931 8/1977 Kosrow et al. ..... 112/272
4,363,281 12/1982 Reinke ..... 112/272 X
4,574,719 3/1986 Balke ..... 112/272

FOREIGN PATENT DOCUMENTS 888768 10/1984 Fed. Rep. of Germany .
977936 11/1982 U.S.S.R. ..... 324/229

*Primary Examiner*—Werner H. Schroeder
*Assistant Examiner*—Andrew M. Falik
*Attorney, Agent, or Firm*—McGlew and Tuttle

[57] ABSTRACT

A sewing machine with a sensing device positioned ahead of a stitch-forming point, senses changes in the thickness of a material being fed by the sewing machine. In order to determine the difference in thickness, the sensing device has a pickup foot capable of vertical movement with a sensing surface that lies on the material adjacent the point the stitch is formed. A sensing lever is movably mounted on the pick-up foot with a sensing arm that lies on the material ahead of the sensing surface, a measuring member detects the relative movement between the pickup foot and the sensing lever.

6 Claims, 7 Drawing Figures

MATERIAL THICKNESS SENSING DEVICE FOR SEWING MACHINES

FIELD AND BACKGROUND OF THE INVENTION

This invention relates in general to sewing machines and in particular to a new and useful device for sensing the thickness of the material being sewn at a stitching point.

German Pat. No. 33 23 214 discloses a sewing machine that has an optoelectronic sensing device to detect changes in the position of the material. All that the prior art solution does is to give off a switching pulse when there is a transition in material positions, and it cannot determine the actual height differential of the approaching difference in thickness.

SUMMARY OF THE INVENTION

The invention provides a sensing device that is capable of determining the precise extent of successive height differences in the course of the execution of a seam as materials are sewn.

The solution provided by the invention yields a measurement change that is in proportion to the approaching height difference. Determination of the precise change in value makes it possible to make the optimal change in sewing machine controls during the transition phase.

Advantageous further developments of the invention prevent excessive swinging out movements of the sensing device and a simple arrangement for changing the lift movement of an upper conveyor mechanism in the transition phase as a material gets thicker.

Accordingly it is an object of the invention to provide a device for sensing the thickness of material which is being fed to a sewing machine and sewn at a stitching point.

A further object of the invention is to provide a material sensing device which is usable with an operating sewing machine for regulating the feed engagement mechanism for advancing materials in accordance with the thickness of the materials being sensed.

A further object of the invention is to provide a sewing machine sensing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
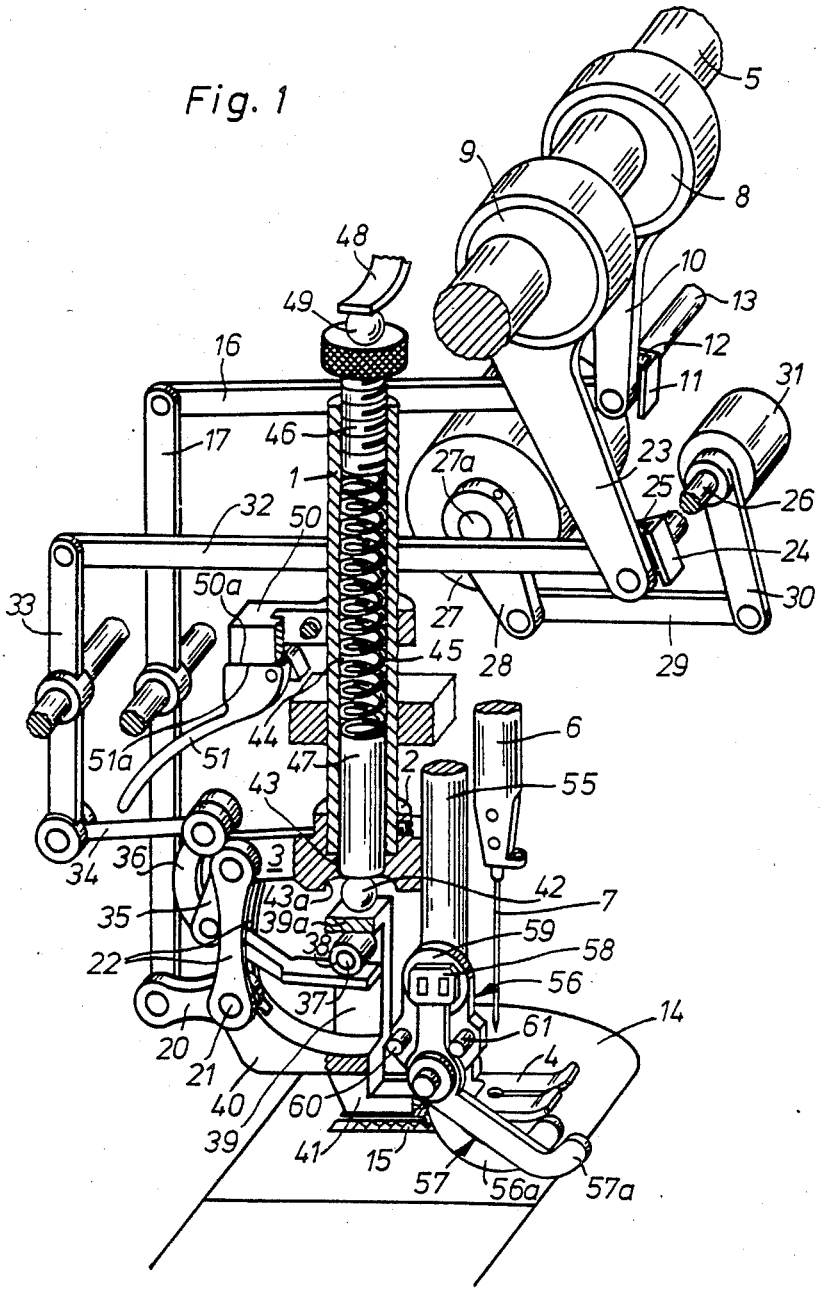
FIG. 1 is a prospective view, partly in section of an upper conveyor mechanism of a sewing machine with a portion of a sensing device portrayed diagrammatically and constructed according to the invention.

Referring to the drawings in particular the invention embodied therein comprises a sewing machine thickness sensing device for sensing the thickness of material being sewn at a stitching point below a reciprocating thread needle carried by a needle bar 6 over a stitch plate 14. The sensing device is advantageously positioned ahead of the stitch forming point to detect changes in the thickness of the material being fed by the sewing machine. In accordance with the invention, the sensing device includes a pickup foot 56 which is capable of vertical movement and has a sensing surface which lies on the material adjacent the point where the stitches are formed. A sensing lever 57 is movably mounted on the pickup foot 56 and has a sensing arm portion 57*a* which lies on the material ahead of the sensing surface. It also has a measuring member 58 which is connected to the sensing arm portion and in the embodiment shown in part of the same lever 57 and it detects the relative movement between the pickup foot 56 and the sensing lever 57 for indicating changes of thickness of the material.

Figure 2:
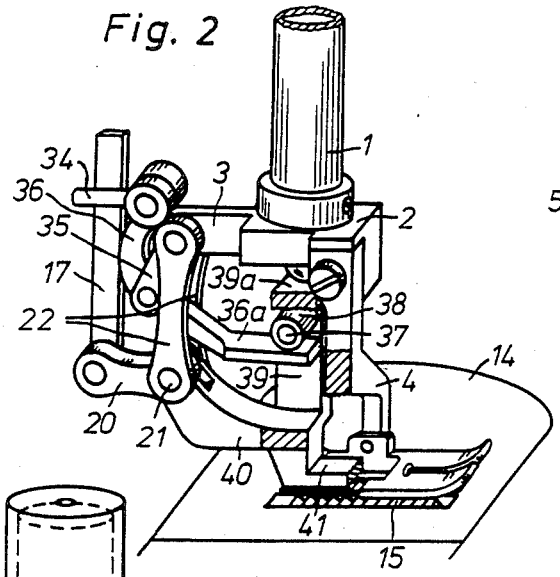
FIG. 2 is a diagrammatic depiction corresponding to FIG. 1 of the upper feed dog and the presser foot with their direct drive parts.

In the housing of the sewing machine is mounted a presser bar 1 (FIGS. 1 and 2), at the lower end of which is attached a support 2, which has an arm 3 projecting to the rear and also supports a presser foot 4.

Also mounted in the housing of the sewing machine is a main shaft 5 which drives a needle bar 6 with needle 7 by means of drive components (not shown). In addition, an eccentric 8 and an eccentric 9 are attached to the main shaft 5.

Eccentric 8 is gripped by an eccentric rod 10 which supports a sliding block 12 that moves in an adjusting link 11. The direction of the slide way of the adjusting link 11 is controlled by an adjusting shaft 13 by means of a hand lever, not shown, that projects outside the housing. It determines the size and direction of the feed motion of a lower feed dog 15 that projects through the needle plate of the machine.

Because of the restricted movement of the sliding block in the adjusting link 11, any sideways motion necessitated by the position of the adjusting link 11 is transmitted to the end of the eccentric rod 10 that bears the sliding block 12. A connecting rod 16 transmits this sideways motion of the eccentric rod 10 via a double lever 17 mounted in the housing and a connecting rod 20 to a link pin 21 that is supported by a pair of rods 22 linked to the arm 3 of the support 2.

Eccentric 9 drives an eccentric rod 23, which supports a sliding block 25 that moves in an adjusting link 24. The direction of the slide way of the adjusting link 24 is controllable via an adjusting shaft mounted in the housing of the sewing machine that constitutes a lift adjustment member 26.

The adjustment of the lift adjustment member 26 is achieved by means of an adjusting motor 27, mounted in the housing, and having a driven shaft 27*a* to which a crank 28 is attached that is connected by a connecting rod 29 with a crank 30 attached to the lift adjustment member 26. The lift adjustment member 26 is also connected to a potentiometer 31 permanently mounted in the housing. The position of smallest lift is set within the dead area of the crank 28, in order to utilize the small control deviations found in this area.

Because of the restricted movement of the sliding block in adjusting link 24, any sideways movement necessitated by the position of the adjusing link 24 is transmitted to the end of the eccentric rod 23 that bears sliding block 25. A connecting rod 32 transmits this sideways motion via a double lever 33 mounted in the housing of the sewing machine and a connecting rod 34 to a lever 36 mounted on an extension 35 of the arm 3 of the support 2. The lever 36 underlies with its free end 36*a* a sliding roller 38 mounted on a pin 37. The pin 37 is held in a stirrup-shaped appendage 39 of a support arm 40, which is mounted on the link pin 21 and supports an upper feed dog 41.

The wall 39*a* of the appendage 39 that extends below the support 2 has a depression for a ball 42 which is capable of movement within the coniform widening, bounded by a stop surface 43*a*, of a hole 43 in the support 2. The hole 43 consitutes a continuation of a bore or hole 44 in the presser bar 1.

The hole 44 contains a spring 45, with one end in an adjusting screw 46 screwed into the upper end of the presser bar 1 and the other end in a movable peg 47 which moves in holes 43 and 44 and is braced against the ball 42.

A leaf spring 48 mounted in the housing presses with its free end against a ball 49 supported in a cup-shaped depression in the adjusting screw 46. The ball transmits the pressure via the presser bar 1 to the presser foot 4, which presses the material against the lower feed dogs 15 or the needle plate 14.

To the presser bar 1 is attached a lifting piece 50 that has a stop face 50*a* for a stop 51*a* of a lever 51 attached on the housing in such a way that it can move up and down.

Figure 3:
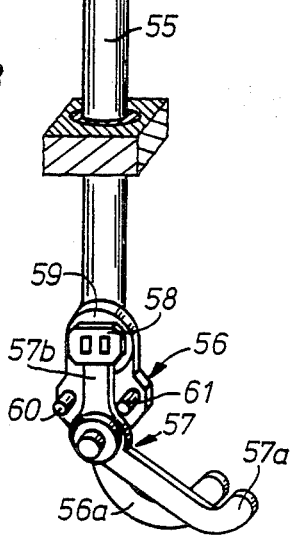
FIG. 3 is a diagrammatic depiction corresponding to FIG. 1 of the sensing device.

A freely moving support bar 55 (see also FIG. 3), to the lower end of which a foot 56 is attached, is mounted in the housing of the sewing machine. The foot bears a sole 56*a*, which under the dead weight of the support bar 55 rests on the material next to the presser foot 4 directly ahead of the stitch formation point. To one side of the foot 56 is attached a jointed sensing lever 57 to which is attached a sensing arm 57*a* that projects ahead of the touch point of the foot 56 and under its own weight rests on the material. An arm 57*b* of the sensing lever 57 projecting upwards bears a sensor 58, e.g. an MDR sensor, opposite which on the support bar 55 is attached a permanent magnet 59. The sensor 58 and permanent magnet 59 are separated by an air gap. Stop pins 60, 61 prevent the sensing lever 57 from being deflected too far. The support bar 55 is connected with a distancing rod 62, the end of which is linked to a piston rod 63*a* of a damping device 63 attached to the housing.

The sensor 58 is used to control the adjusting motor 27 and is so designed that its output signal increases when it is pivoted in either direction away from its mid-position with respect to the permanent magnet 59.

Figure 5:
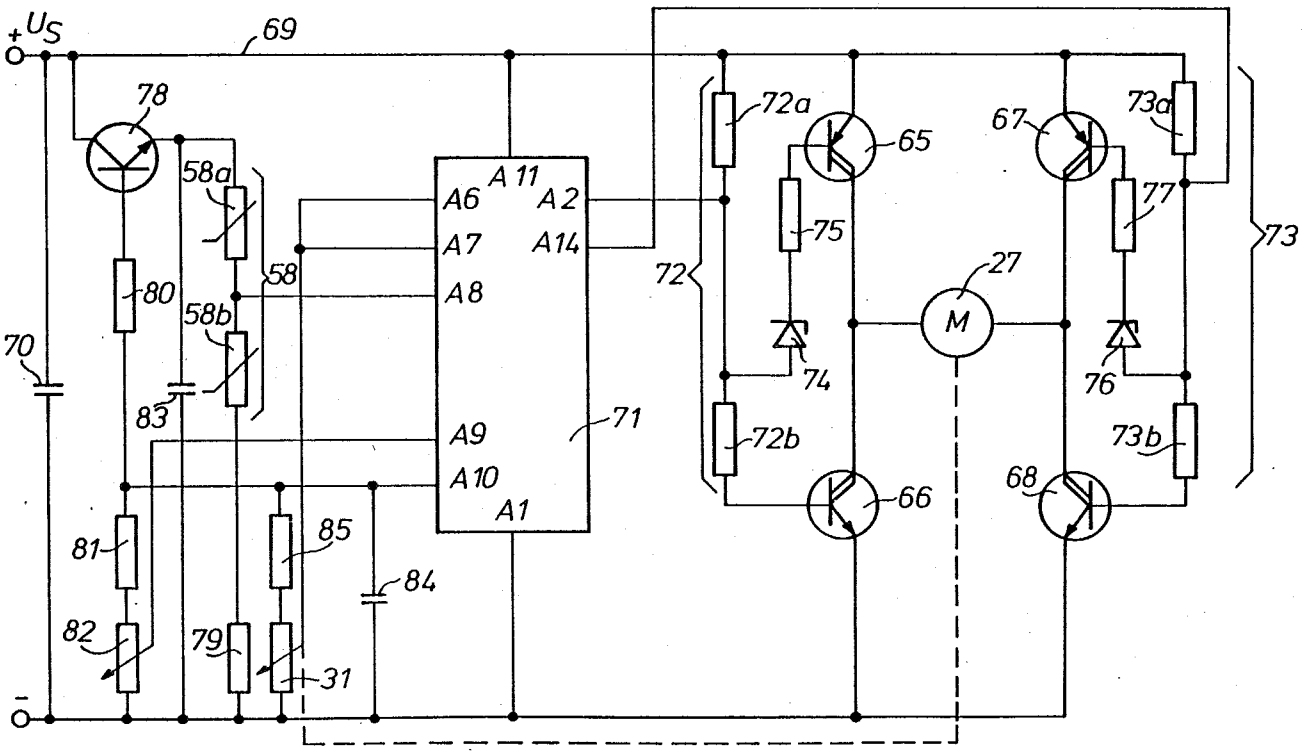
FIG. 5 is a circuit diagram for controlling the adjustment of the lift drive of the upper conveyor mechanism.

FIG. 5 shows a circuit for operating the adjusting motor. In this circuit, the adjusting motor 27 lies in the bridge diagonal of a bridge circuit created by four switch transistors 65 through 68. Switch transistors 65 and 67 are of the p-n-p type. Their emitter contact is connected to a connecting line 69 for the operating voltage $U_S$. Switch transistors 66 and 68 are of the n-p-n type. Their emitter contact is grounded. Switch transistors 65 through 68 operate as switches to switch the operating voltage $U_S$ on and off or over to the adjusting motor 27.

The connecting line 69, which is grounded via a capacitor 70, is also connected directly to the contact A11 of a window discriminator 71 (e.g., TCA 965 by the Siemens Company) and is connected via a voltage divider 72 consisting of resistors 72*a* and 72*b* to the base contact of switch transistor 66 and via a voltage divider 73 consisting of resistors 73*a* and 73*b* to the base contact of switch transistor 68. The connection between resistors 72*a* and 72*b* is directly connected with contact A2 of the window discriminator 71 and via a series connection consisting of a Zener diode 74 and a resistor 75 with the base contact of switch transistor 65. The connection between resistors 73*a* and 73*b* is directly connected to contact A14 of the window discriminator 71 and via a series connection consisting of a Zener diode 76 and a resistor 77 to the base contact of switching transistors 67. Contact A1 of the window discriminator 71 is directly grounded.

The connecting line 69 is grounded via the collector-emitter segment of a transistor 78, the sensor 58 consisting of two Hall sensors 58*a* and 58*b* and a resistor 79. The connection between the two Hall sensors 58*a* and 58*b* lies on contact A8 of the window discriminator 71.

Between the base of the transistor 78 and the ground lie two resistors 80 and 81 and a potentiometer 82, whose tap is connected with contact A9 of the window discriminator 71. Between the emitter contact of transistor 78 and the ground lies in addition a capacitor 83. Another capacitor 84 is connected between contact A10 and the ground. Finally, between contact A10 and the ground is a series connection consisting of a resistor 85 and a potentiometer 31, whose tap is connected with both contacts A6 and A7 of the window discriminator 71. The latter contact A10 is also hooked up with the connection between the two resistors 80 and 81.

The transistor 78 provides a series stabilization for the operating voltage tapped at the emitter for the sensor 58, whereby capacitor 84 evens out the reference voltage for the transistor 78 and capacitor 83 eliminates wild swings.

The window of the window discriminator 71, i.e. the switching range within which the circuit does not respond to changes in actual values, is given by the potential at the tap of the potentiometer 31, and the window mid-point is determined by the median voltage at a given time at the contact A8 of the sensor 58. Reference and actual values are available in the form of voltages at the tap of the sensor 58 and the potentiometer, which both lie on the constant voltage of the contact A10 of the window discriminator 71.

Figure 4A:
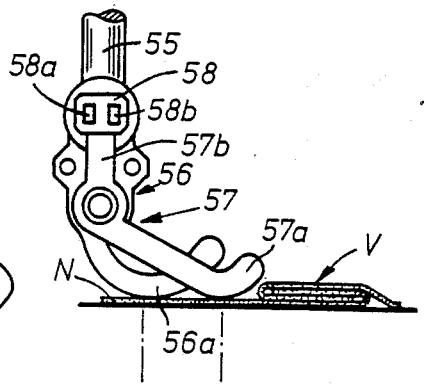
FIG. 4*a*, FIG. 4*b* and FIG. 4*c* are views similar to FIG. 3 showing various operating phases during the transition over a thickened portion of the workpiece material.
Figure 4A:
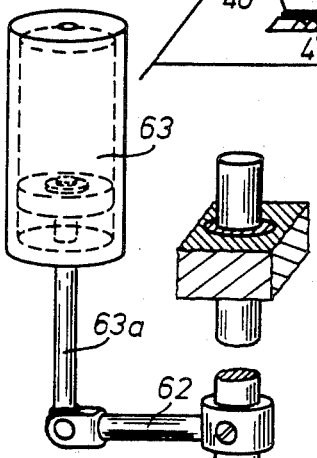

The device works as follows:

Starting with the sewing of a material N of even thickness (FIGS. 1, 4*a* and 5), where both the sensing arm 57*a* and the sole 56*a* lie on the material N at the same height, arm 57*b* is in its center position. The voltage at contact A8 determines the window mid-point of the window discriminator 71. The adjustment motor 27 is at one of its end positions, in which the lift adjustment mechanism 26 conveys its minimum normal lift to the lift drive via the adjusting link 24. In that situation, from the tap of the potentiometer 31 a voltage is given off to the input points A6 and A7 of the window discriminator 71 that lies within its window. The output points A2 and A14 are thus switched to the operating voltage $U_S$. The adjustment motor 27 is not running; it is short circuited via switching transistors 66 and 68.

By turning the arm shaft 5, both eccentrics 8 and 9 are driven, along with the other sewing tools.

Eccentric 9 swings the eccentric rod 23 out and thereby shifts the sliding block 25 in the adjusting link 24. Depending on the position of the adjusting link 24, the double lever 33 via the connecting rod 32 and the lever 36 via the connecting rod 34 will be swung out to a greater or lesser extent. In the process, the end 36*a* of lever 36 rises and falls.

When end 36*a* rises, its upper surface in turn presses the upper feed dog 41 upward via the sliding roller 38. This raising occurs against the pressure of the spring 45 bearing on the ball 42. When the upper feed dog 41 is lifted off the material N, the dog is held only by the presser foot, which is under pressure from the leaf spring 48.

When end 36*a* falls, the lever 36 releases from the slide roller 38, as soon as the upper feed dog 41 is applied to the material N under the influence of the spring 45. The presser foot 4 under pressure from the leaf spring 48 and the feed dog 41 under the influence of the spring 45 now both press down on the material N.

Eccentric 8 swings the eccentric rod 10 out and thereby shifts the sliding block 12 in the adjusting link 11. Depending on the position of the adjusting link 11, which may be altered by turning the adjusting shaft 13, the double lever 17 is swung out to a greater or lesser extent via the connecting rod 16. The upper feed dog 41 connected with it via connecting rod 20 then performs correspondingly large feed motions.

These horizontal movements of the feed dog 41 are made possible by the rolling contact motion between the slide roller 38 and the end 36*a* of the lever 36, between the wall 39*a* and the ball 42, and between the ball and the moving plug 47. The stop surface 43*a* acts as a boundary to the movement of the ball 42.

Figure 4B:
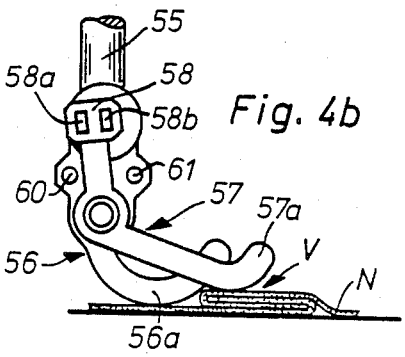

As soon as a thickening V (FIG. 4*b*) of the material N, e.g., in the form of a pleat, raises the sensing arm 57, the sensor 58 swings out to the left, whereupon the resistance of Hall sensor 58*a* decreases and the resistance of Hall sensor 58*b* increases. The voltage at the input point A8 of the window discriminator 71 thereupon increases and shifts the window mid-point upward; the voltage at input point A7 falls below the lower threshold of the window, and the output point A14 receives grounding potential. Output point A2 stays at operating voltage $U_S$. Switch transistors 66 and 67 are then switched to open, while switch transistors 65 and 68 are closed. Current is now flowing through the adjustment motor 27 in the direction in which the adjusting motor 27 is driven so that the latter, via crank 28, connecting rod 29 and crank 30, turns the adjusting shaft 26 and hence the adjusting link 24 to a position that increases the lift motion of the upper feed dog 41. The lift of the upper feed dog 41 is thus correspondingly increased during the phase when it moves up to the higher material level.

By turning the adjusting shaft 26, the potentiometer 31 is adjusted so that there is a change to a higher potential at its tap. As soon as this potential reaches the newly established window range, the output point A14 of the window discriminator 71 switches to operating voltage $U_S$, whereupon switch transistor 68 is again opened and switch transistor 67 is closed. The adjusting motor 27 is short circuited via both switch transistors 66 and 68.

Figure 4C:
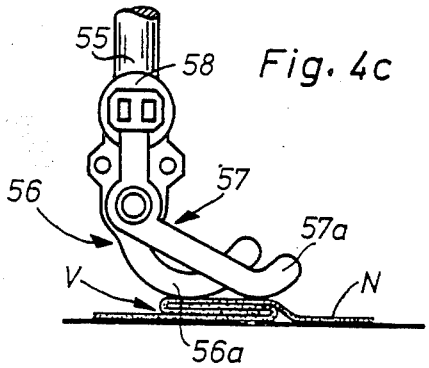

As soon as the sole 56*a* of the foot 56 engages onto the thickness V (FIG. 4*c*), the arm 57*b* of the sensor 58 again swings back to its zero position. The potential at the contact A8 of the window discriminator 71 thereupon drops back to its original value. The window mid-point and hence the window range as well are shifted downward, whereupon the potential at contact A6 moves out of window range and the contact A2 switches to grounding potential. Switch transistor 65 is thereby opened and switch transistor 66 is closed, so that the current now flows to the adjusting motor 27 in the other direction and also drives it in the opposite direction. Adjusting link 24 is turned to the position in which it regulates the upper feed dog 41 for minimum lift. At the same time, the tap of the potentiometer 31 is turned to a position in which the potential at the contcts A6 and A7 of the window discriminator 71 falls within window range, whereupon contact A2 is switched back to operating voltage $U_S$ and the adjusting motor 27 is switched off.

In order to raise the presser foot 4, the hand lever 51 is moved upward. The stop face 51*a* thereby raises lifting piece 50 and the presser bar 1 together with the presser foot 4. Because of the linkage of the upper feed dog 41 as well, via the pair of connecting rods 22, and via the linkage of the lever 36 to the support 2, which is firmly attached to the presser bar 1, the upper feed dog 41 is thereby raised to the same extent.

While a specific embodiment of the invention has been shown and described in detail to illustrate the application of the principles of the invention, it will be understood that the invention may be embodied otherwise without departing from such principles.

What is claimed is:

1. A sewing machine thickness sensing device for sensing the thickness of material being sewn at a stitching point, comprising a pickup foot having a material engaging sensing surface, means mounting said pickup foot for vertical movement with its sensing surface lying on the material adjacent the point at which the stitch is formed, a sensing lever movably mounted on said pickup foot with a sensing arm portion lying on the material ahead of said sensing surface, and a measuring member connected to said sensing lever and movable in response to the movement of said sensing arm portion on the material to indicate changes of thickness of the material by detecting the relative movement between said pickup foot and said sensing lever.

2. A device according to claim 1, including a stop at spaced locations on each side of said measuring member limiting the swinging of said measuring member, said measuring member comprising an arm portion of a double arm lever, the other arm of which comprises said sensing arm portion.

3. A device according to claim 1, including a support bar for mounting said pickup foot to a sewing machine, and a damping member connected to said support bar for limiting its upward and downward movement.

4. A device according to claim 1, including a presser foot engageable with material being sewn during feeding of material being sewn, spring means biasing said presser foot into engagement with the material, feed means including an upper feed dog for feeding the material, lifting mechanism including a lift adjustment member connected to said upper feed dog and said presser foot and adjustable to change a lifting amount of at least said upper feed dog, a control mechanism connected to said measuring member, and an adjustment motor for adjusting said lift adjustment member.

5. A device according to claim 4, wherein said adjustment motor has a transmission, said lift adjustment member being connected to said transmission.

6. A device according to claim 4, including a transmission connected between said motor and said lift adjustment member, said motor having a short stroke with one end position corresponding to a minimum lifting amount for said lift adjustment member and an opposite end position corresponding to a maximum lifting amount.

* * * * *